United States Patent [19]

Stenmark

[11] Patent Number: 4,641,134

[45] Date of Patent: Feb. 3, 1987

[54] INFRARED-SENSITIVE DETECTOR CONSISTING OF PELTIER ELEMENT

[76] Inventor: Lars Stenmark, Klevbergsvägen 53, Stenhamra, Sweden

[21] Appl. No.: 653,268

[22] PCT Filed: Feb. 17, 1984

[86] PCT No.: PCT/SE84/00058

§ 371 Date: Sep. 17, 1984

§ 102(e) Date: Sep. 17, 1984

[87] PCT Pub. No.: WO84/03382

PCT Pub. Date: Aug. 30, 1984

[30] Foreign Application Priority Data

Feb. 18, 1983 [SE] Sweden ..... 8300915

[51] Int. Cl.[4] ..... G08B 13/18

[52] U.S. Cl. ..... 340/567; 340/600

[58] Field of Search ..... 340/567, 565, 600, 673, 340/587; 250/340, 352

[56] References Cited

U.S. PATENT DOCUMENTS

| | | | |
|---|---|---|---|
| 3,576,996 | 5/1971 | Stevens | 250/352 X |
| 3,743,835 | 7/1973 | Koncen | 250/352 |
| 3,760,399 | 9/1973 | Schwarz | 340/567 |
| 4,087,687 | 5/1978 | Bean | 250/352 X |
| 4,143,269 | 3/1979 | McCormack et al. | 250/340 X |
| 4,166,390 | 9/1979 | Benzinger | 250/352 X |
| 4,307,388 | 12/1981 | Doenges et al. | 340/567 |
| 4,327,286 | 4/1982 | Thoma | 340/583 X |

*Primary Examiner*—James L. Rowland
*Assistant Examiner*—Brian R. Tumm
*Attorney, Agent, or Firm*—Pollock, Vande Sande & Priddy

[57] ABSTRACT

The invention is concerned with a device for the detection of moving objects which are warmer or cooler than a static environment. The device consists of a detector unit (1) connected to a preamplifier (2), a signal processing unit (3), and output detector device (4). The device is characterized in that the detector unit consists of a conventional Peltier element (5), one of whose sides (6) is placed in good thermal contact with a heat sink (8) and that the other side (7) of the Peltier element (5) is used as a radiation-sensitive detector surface. This radiation-detecting surface may be provided with a radiation-absorbing layer (9). The current supply terminals (10, 12) of the Peltier element are connected to a band-pass filter (11) which, in turn, is connected to a low-noise preamplifier (2). By having the electronic circuitry based on C/MOS technology, and since the detector draws no current, provision of a suitable battery makes the unit self-sufficient for approximately ten years. The device according to the invention can be arranged to communicate with other devices in an alarm situation by wire-less technology.

3 Claims, 3 Drawing Figures

INFRARED-SENSITIVE DETECTOR CONSISTING OF PELTIER ELEMENT

FIELD OF THE INVENTION

The present invention is related to an alarm detector for the detection of e.g. unauthorized entry by detecting the radiation given off by the intruder.

BACKGROUND OF THE INVENTION

It has long been known in the art to detect the presence of human beings and animals by detecting the heat radiation that they emit. The devices that have generally been used for the purpose contain an infrared-sensitive detector of some kind, generally one of the types pyroelectric, thermopile detector, certain semiconductor detectors such as lead sulphide detectors, or similar. These detectors are either insensitive, expensive, require cooling, or draw continuous current during their use.

An alarm detector which functions in such a manner that it draws very little or no current when it does not sense any signal, which does not require cooling, has low inherent noise, and is inexpensive, would find wide application. One consequence of these properties is that it need not necessarily be connected to the mains even if it operates for years.

SUMMARY OF THE INVENTION

The purpose of the present invention is therefore to provide a device for the detection of unauthorized entry by detecting the heat radiation given off by the intruder. Such device shall be cheap and simple to manufacture, draw very little current when not sending an alarm signal, and have high sensitivity.

The device of the invention, allows detecting moving bodies that are warmer or cooler than a static environment, contains an infrared-sensitive detector that is connected to a preamplifier and a signal processing unit arranged to emit electrical signals to an output means. According to the invention, the detector consists of a Peltier element with one hot side and one cold side and a current supply terminal. One of the hot or cold sides of the Peltier element is placed in good thermal contact with a heat sink of high heat capacity and the other side is arranged to serve as the radiation-sensitive detector surface of the detector, and the current supply terminal of the Peltier element is connected with the input to a band-pass filter whose output is connected to the input of the preamplifier.

It is moreover appropriate, according to the invention, for the preamplifier and the signal processing unit both to be based on C/MOS technology and for the signal processing unit to be arranged not only to initiate current supply to the output but also to send an alarm signal to the output when an alarm situation arises.

It is also advantageous for the side of the Peltier element that serves as the radiation-sensitive detector surface to be provided with a heat-absorbing layer.

The invention is described more particularly below with reference to the attached FIGS. 1 through 3, wherein:

DESCRIPTION OF THE PREFERRED EMBODIMENT

Figure 1:
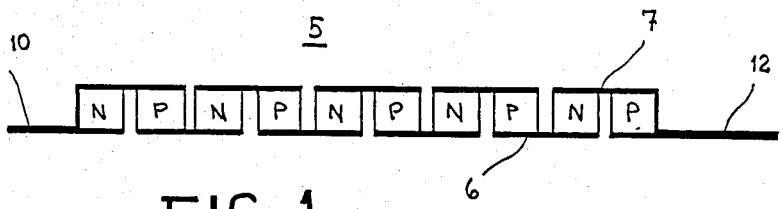
FIG. 1 shows the general structure of a Peltier element as known in the art.

FIG. 1 shows the typical structure of a Peltier element. Such elements are normally used for heating or cooling objects, such as a component requiring to be cooled. Detectors, too, are often cooled by means of Peltier elements, often cascaded. Thus the Peltier element is not designed to be used as a detector. However, it is cheap, has low internal impedance, is strong, and has large surface area compared to most detectors. Moreover, it does not require any current supply, but actually produces current when there is a temperature difference between the hot side 6 and the cold side 7. The Peltier element consists of a number of p-n junctions connected in series between two current supply terminals 10, 12.

Figure 2:
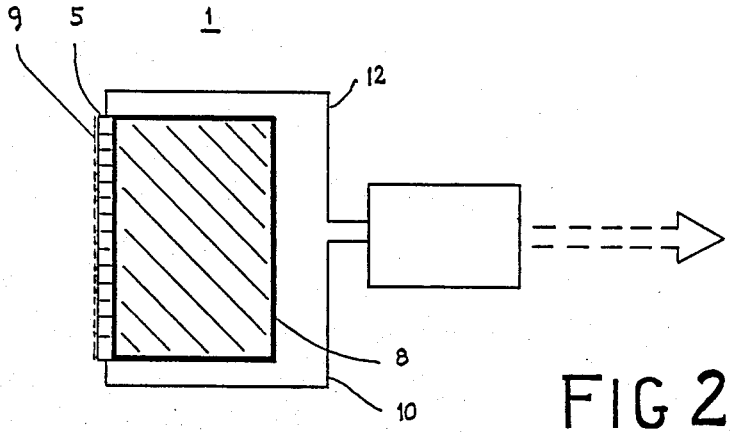
FIG. 2 shows the construction of the detector unit according to the present invention.

FIG. 2 shows the construction of the detector unit 1 of the device according to the invention. The Peltier element 5 is arranged with its hot side 6 to the heat sink 8, which is preferably a block of metal with high thermal conductivity, such as copper or aluminium. The cold side 7 of the Peltier element is used as the detector surface and may be provided with a heat-absorbing layer 9. Under conditions of perfect thermal balance there will be no current flow or voltage between the current supply terminals 10, 12. If the radiation incident upon the side used as the detector surface increases or decreases, there will arise a voltage/current of either polarity depending on whether the incident radiation has increased or decreased.

What has been called the hot side 6 will become a cold side if the polarity of the current supply is reversed, and hence one can equally well place the cold side 7 against the heat sink 8. It is essential that the thermal contact with the heat sink 8 be very good, as the sensitivity of the detector unit 1 depends heavily thereon. The construction of the detector unit is similar to that of a thermopile detector, but Peltier elements are considerably cheaper, have larger detecting surface area and lower internal impedance and hence also lower inherent noise.

Figure 3:
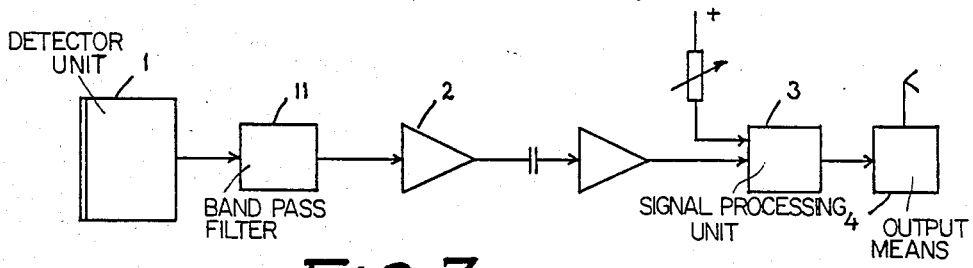
FIG. 3 shows the electronic circuitry of a device according to the invention in the form of a block diagram.

FIG. 3 shows how the detector of a device according to the present invention is connected to the subsequent elecronic circuitry. The detector unit 1 is connected directly to a low-pass filter or band-pass filter 11 whose output is connected to a very low-noise preamplifier 2. This low-pass filter 11 may have a cut-off frequency as low as one or possibly two hertz, which can be adjusted more exactly to the frequency range produced normally by a person in motion. This will depend on the configuration of the room, the distance, the person's angular velocity as seen from the location of the detector, and the thermal conductivity of the detector. After the preamplifier it may be appropriate to have a plurality of additional, AC-coupled, preamplifiers. The signal processing unit 3 consists in its simplest form of a threshold detector, voltage comparator. This is connected to a control circuit which activates or makes the current to an alarm function/output means 4. Alternatively the signal processing unit may be of a more complicated type, e.g. such that it is capable of distinguishing between two types of signals by means of the magnitude and size of the derivative.

It is furthermore advisable to have all the preamplifier steps constantly energized and compensated at all times for various operating phenomena by means of feedback integrators. Since the detector has zero current consumption it is possible using C/MOS technique and by means of a suitable battery to make the device current self-sufficient for up to ten years. The alarm can be given by wire-less communication with a receiver that may be connected to the mains. This wire-less communication can take place by radio pulse, ultrasound, or IR radiation.

Since the device according to the invention can be made small and electrically completely self-sufficient, a room can be equipped with a plurality of detecting units communicating with a master unit.

Besides its use as an alarm, e.g. in bedrooms and elsewhere, the device of the invention can also be used for counting passing objects. If the objects themselves are warmer or cooler than the surroundings the operation is direct. Otherwise one can cause the alarm detector to be illuminated by a beam, which in a manner known to the art will be interrupted by the objects as they pass through it.

What we claim is:

1. A device for the detection of moving bodies which are warmer or cooler than the surroundings, comprising an infrared-sensitive detector connected to a preamplifier and a signal processing unit arranged to send electrical signals to an output means, wherein said detector consists of a Peltier element having a hot side and a cold side and a current supply terminal, one side of said Peltier element being placed in good thermal contact with a heat sink of high heat capacity and the other side being arranged to serve as the radiation-sensitive detector surface of the detector; and further characterized in that the current supply terminal of the Peltier element is connected to the input of a band-pass filter whose output is connected to the signal input of said preamplifier.

2. A device according to claim 1, wherein said preamplifier and said signal processing unit are both based on C/MOS technology and wherein said signal processing unit is arranged both to initiate current supply to said output means and to send an alarm signal thereto when an alarm situation arises.

3. A device according to claim 1 or 2, characterized in that said side used as the radiation-sensitive detector surface is provided with a heat-absorbing layer.

* * * * *